United States Patent [19]

Popovski et al.

[11] 4,374,370

[45] Feb. 15, 1983

[54] HELICAL RESONATOR FILTER

[75] Inventors: George N. Popovski, Weston; Peter Vizmuller, Thornhill, both of Canada

[73] Assignee: Motorola, Inc., Schaumburg, Ill.

[21] Appl. No.: 248,753

[22] Filed: Mar. 30, 1981

[51] Int. Cl.[3] ..... H01P 1/20; H01P 7/00

[52] U.S. Cl. ..... 333/202; 336/84 C; 336/87

[58] Field of Search ..... 333/202, 219, 205, 207, 333/208, 209; 336/87, 220, 73, 84 C, 75, 84 R, 77, 79, 137, 138; 334/66, 70, 74, 75

[56] References Cited

U.S. PATENT DOCUMENTS

| | | | |
|---|---|---|---|
| 1,911,980 | 5/1933 | Vance | 336/144 X |
| 1,993,794 | 3/1935 | Meyerhans | 336/146 X |
| 2,308,863 | 1/1943 | Craymer | 336/144 X |
| 2,383,475 | 8/1945 | Dodington . | |
| 2,570,650 | 10/1951 | Davis | 336/138 X |
| 2,691,141 | 10/1954 | Hollis | 336/139 |
| 3,621,484 | 11/1971 | Sholt | 333/202 |
| 3,691,487 | 9/1972 | Yoshimoto | 333/202 |
| 3,836,881 | 9/1974 | Koizumi | 336/87 |
| 4,200,853 | 4/1980 | De Jong et al. | 336/192 |
| 4,210,884 | 7/1980 | Tabuchi et al. | 333/219 X |
| 4,284,966 | 8/1981 | Wanat | 333/202 |

FOREIGN PATENT DOCUMENTS

| | | | |
|---|---|---|---|
| 2909208 | 9/1980 | Fed. Rep. of Germany | 333/202 |

*Primary Examiner*—Thomas J. Kozma

*Attorney, Agent, or Firm*—Rolland R. Hackbart; James W. Gillman

[57] ABSTRACT

A helical resonator filter comprising two or more helical coils is provided with a conductive coupling element between the helical coils for modifying the filter bandwidth. A coupling element is a conductor and is positioned in the maximum of the electrical field at the open end of the helical coils or at the maximum of the magnetic field at the grounded end of the coils, or both thereby creating controlled change in capacitive (electrical) or inductive (magnetic) coupling, respectively. A block of suitable dielectric with grooves for receiving the coupling element and the ribs on the inside of a conductive cover can be used to center the coupling element and the whole filter assembly structure when the cover is put in place and clamps the block securely to the base of the filter. Additional coupling elements can be used in a similar manner as above when additional helical coils are used in a filter.

6 Claims, 7 Drawing Figures

HELICAL RESONATOR FILTER

FIELD OF INVENTION

This invention is directed to an improved helical resonator filter with a coupling element for modifying the filter bandwidth.

BACKGROUND OF THE INVENTION

Conventional helical filter includes two or more helical coils, each coil being housed within an enclosed resonating chamber. The coils are positioned relative to each other spatially and electrically coupled through apertures in the walls separating chambers to provide characteristic bandwidth. The maximum bandwidth of the filter so formed is determined by the geometry of the coils and the chambers and the size of the apertures. The required coupling of the elements in a helical filter is achieved by adjusting the size of the apertures between adjacent resonators.

The increase of the exposed parts of one helix to the adjacent helix causes increase in coupling resulting in larger filter bandwidths. In the extreme case where the walls between the filter elements are completely removed, the maximum coupling for the given size of enclosure and coils is achieved. Additional increase of filter bandwidth can be obtained either by increase of the size of the filter elements, which is not always possible, or by some means of further increase in coupling. Thus, given a physical size of the filter, the maximum bandwidth that can be afforded by the conventional helical filter is fixed.

SUMMARY OF THE INVENTION

It is an object of the present invention to improve helical resonator filter made of helical coils and, in particular, to increase the bandwidth of a helical resonator filter of increased bandwidth beyond the maximum bandwidth afforded by the conventional helical resonator filter of a given physical size.

The foregoing objects of the present invention are attained by providing a coupling element placed between the helical coils for increasing the bandwidth of the filter. According to an aspect of the present invention, the coupling element of a U-shaped conductor molded within a suitable dielectric material is placed between the coils for better mechanical stability and reproducibility.

According to another aspect of the present invention, a block of polypropylene or other suitable dielectric with grooves to receive the U-shaped element and shaped to fit in between the adjacent coils is used to provide spatial integrity of the position of the U-shaped element relative to the coils whereby the bandwidth characteristics of the filter are maintained. According to yet another aspect of the present invention, the block is provided with additional grooves down the side thereof into which ribs of the filter housing can be received. In this manner the cover forms the shielding chamber and the block is shaped to center the clamp coils securely to the base of the shielding chamber.

According to still another aspect of the present invention, a conductive loop of one or more turn is placed near the grounded ends of the two or more helixes that make the filter. The appropriate metal coupling elements can be located in the maximum of the electrical field at the open end of the helical coils or the maximum of the magnetic field at the grounded end of the helical coils creating controlled increase in capacitive or inductive coupling, thus more attention is achieved on the low or high frequency side of the response curve respectively.

The foregoing and other aspects of the present invention will be more clearly understood from the detailed description of the illustrative examples of the present invention in conjunction with the accompanying drawings.

DETAILED DESCRIPTION

A prior art helical filter typically includes a housing of a rectangular cross-section with two or more chambers, disposed one after the other, in a cascade. The housing is made of a conductive metal such as copper or aluminum. The adjacent chambers are separated by a separating wall with an aperture. The size and position of the aperture determine the coupling factor of the filter which controls the bandwidth characteristic of the filter. The larger the aperture, the higher the coupling factor becomes.

In accordance with the conventional helical coil filter, the coil is disposed in each of the chambers, and one end is grounded and fixedly attached to the conductive housing which acts as the ground and the other end is free to stand within the chamber. Typically, suitable means, such as a bobbin made of a non-conductive material around which the coil is wrapped helically is disposed within the coil for the purpose of increasing mechanical stability of the coil. One end of the coil is attached to the housing and thereby is grounded. The other or the free end of the coil is fixedly attached to the bobbin.

Fine tuning of the helical resonators is achieved by means of a threaded screw inserted through the top of the metal housing in line with the coil axis at the ungrounded ends of the coil. The bandwidth characteristic of the filter is largely determined by the size of the coil, the size of the chamber, and the apertures between the chambers. Thus, the maximum bandwidth that can be provided by a given helical coil filter of the aforementioned design is a function of the geometry, that is, the size of the coil, the chamber and the aperture in the wall between the chambers.

Figure 1:
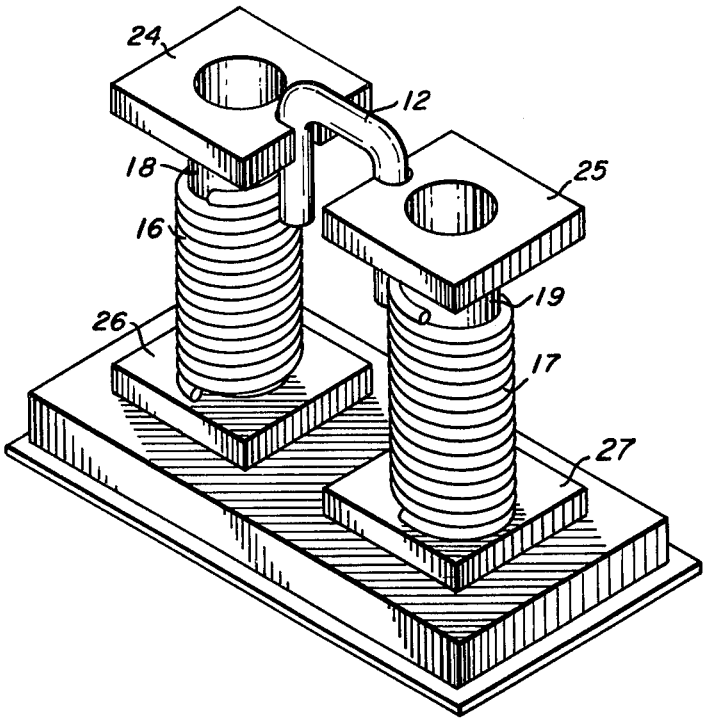
FIG. 1 shows a perspective view of a helical resonator filter with a coupling element located in the maximum of electrical fields in accordance with the present invention.

Referring to FIGS. 1–6, in accordance with the present invention, by providing suitable coupling elements which shall be described in detail herein below, the bandwidth of the filter is increased to over ten times that of a helical resonator filter without the coupling element. Referring to FIG. 1, there is shown a perspective view of a conventional helical coil filter with cover removed therefrom with the a U-shaped conductive coupling element 12 in an inverted position. While the U-shaped coupling element is shown placed in an inverted position it need not be so limited. It can be easily positioned in an upright position as well. The resonator includes a pair of coils 16 and 17 respectively wrapped around plastic bobbins 18 and 19. As illustrated, the plastic bobbins 18 and 19 are of a cylindrical shape coaxial with the axes of the coils 16 and 17. The cylindrical bodies 18 and 19 have plastic top plates 24 and 25 and bottom plates 26 and 27 which are integral parts of the bodies.

Figure 2:
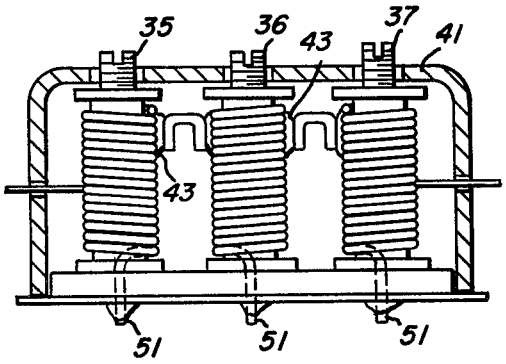
FIG. 2 shows cut away side view of a helical resonator filter with coupling elements and three helical coils with coupling elements located in the maximum of electrical fields.
Figure 3:
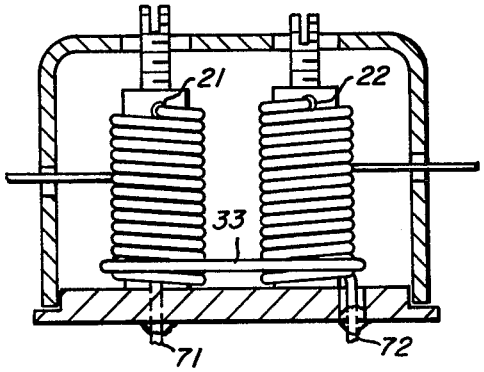
FIG. 3 shows a cut away side view of a helical resonator filter with a coupling element located in the maximum of magnetic field.

Preferrably the top and bottom plates 24–27 in FIG. 1 are of such a shape as a rectangular block so that detents or recesses provided in the cover and base to receive the plates lock them in place and thus the coils in place. Hence, the plastic top and bottom plates serve the function of anchoring and securing the bobbins in place within a housing 41 made of a conductor such as copper, as illustrated in FIG. 2. The bottom ends 51 of the coils are fixed to the bottom part of the housing as illustrated in FIG. 2 and thereby are grounded as the housing is grounded. The top or free end of the coil is firmly fixed to the body of the bobbin members 18 and 19 in FIG. 1 at 21 and 22 as shown in FIG. 3. By rotating tuning screws 35, 36 and 37 in FIG. 2 the filter can be adjusted for fine-tuning in a conventional manner.

In accordance with the present invention, the coupling element 12 is disposed between the two helical coils at the free ends thereof, as shown in FIG. 1. The coupling element 12 is of a U-shaped circular cross-section or flat rectangular cross-section of a bus-type conductor. Positioning of the U-shaped coupling element causes the filter bandwidth to increase substantially, well beyond the maximum bandwidth afforded by the geometry of the coils and the housing without the coupling element. For example, a filter in accordance with the present invention increased the bandwidth from 10% of the central frequency to more than 50%. This is more than a magnitude of order jump in terms of the increase in the bandwidth provided by the use of the U-shaped coupling element. The increase in the bandwidth provided by the use of the coupling element of course need not be limited to a coil filter with two helical coils. It can be readily extended to helical resonator filters which include more than two helical coils as illustrated in FIG. 2.

A coupling element in the form of a conductive wire 33 loop of one or more turns above can be used as shown in FIG. 3. The conductive wire is insulated so that it does not touch and make electrical contact with helical coils. As illustrated there, the insulated copper wire is wrapped around in the form of a loop that loops the two coils at the bottom end thereof to provide coupling for the magnetic field. Note that the bottom ends 71 and 72 of the coil are brought out through the bottom of the housing and firmly attached to the bottom plate of the housing, and thus grounded. The U-shaped element must be positioned rigidly in proper spatial relationship to the coils. To accomplish this, this element 12 may be positioned at the free ends of the coil through suitable detents in the top plates 24 and 25, as illustrated in FIG. 1 or affixed to the free end of coil by suitable glue 43 as shown in FIG. 2.

Figure 4:
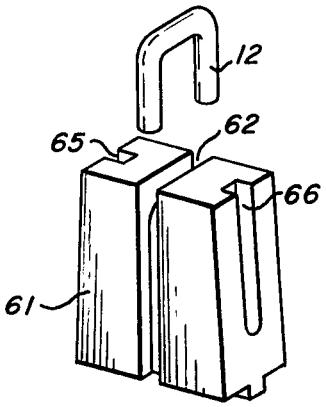
FIG. 4 shows a block of polypropylene or other suitable dielectric with grooves to receive the coupling loop and ribs on the filter cover.
Figure 5:
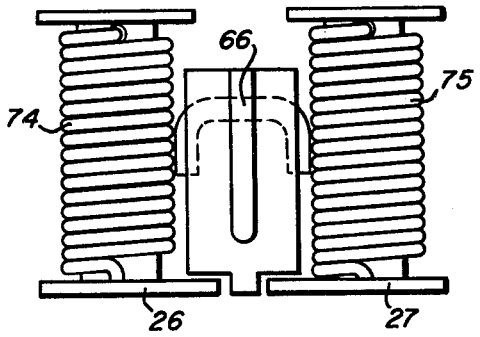
FIG. 5 shows a side view of a resonator filter in which the block shown in FIG. 4 is placed between a pair of helical coils and the block having the U-shaped coupling element disposed in the groove designed to receive the coupling element.
Figure 6:
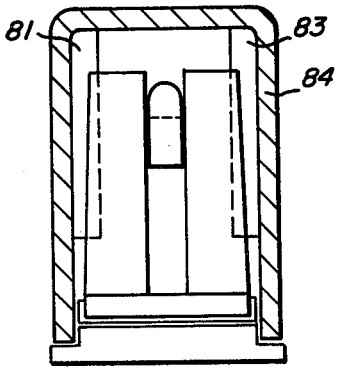
FIG. 6 shows a filter with the helical coils and the block shown in FIG. 4 disposed within the cover thereof that shows the ribs on the inside wall of the cover fitted into the grooves in the block designed to receive the rib.

Referring to FIG. 4, there is shown yet another example of putting the coupling element in place properly. It is a block 61 of polypropylene or other suitable dielectric material. The dielectric block is suitably shaped and is provided with a groove 62 shaped to receive the U-shaped coupling element 12. The block is provided with two additional grooves 65 and 66 on the opposite sides which are dimensioned to fit ribs, 81 and 83 (FIG. 6) on the inside of the metal filter cover 84. The ribs, when placed in the grooves 65 and 66, center the polypropylene block and clamp it securely to the coil bases 26 and 27 when the cover 84 is placed in position. The block is designed so that it positions the U-shaped element with required precision as illustrated in FIGS. 5 and 6 between two helical coils 74 and 75.

The size of the coupling element and the dielectric block affect the degree of coupling, and thus the bandwidth. Also, any dielectric such as glue or epoxy used to secure the coupling elements in position also affect the bandwidth. The use of a block of polypropelene or other suitable dielectric with grooves to receive the U-shaped coupling element and the filter cover in the manner described hereinabove insures the repeatability of filter characteristics in a production line environment without the need for elaborate positioning fixtures. As a result, the cost of manufacturing the resonator filter assembly is substantially reduced.

A filter with the following specific dimensions was built using the dielectric block described herein above with reference to FIG. 2 and a U-shaped coupling elements;

Cavity width = 10.5 mm; Cavity Height = 18.7 mm;

Helix Outside Diameter = 6.6 mm; Wire Gauge = 30;

Number of turns of the coil for the three helixes; $27\frac{1}{2}$, $23\frac{1}{2}$, $27\frac{1}{2}$ turns;

U-shaped Coupling Element made of a 17 gauge enamel coated wire, with two arms, 3.0 mm and 5.5 mm long, separated by 5.2 mm.

Figure 7:
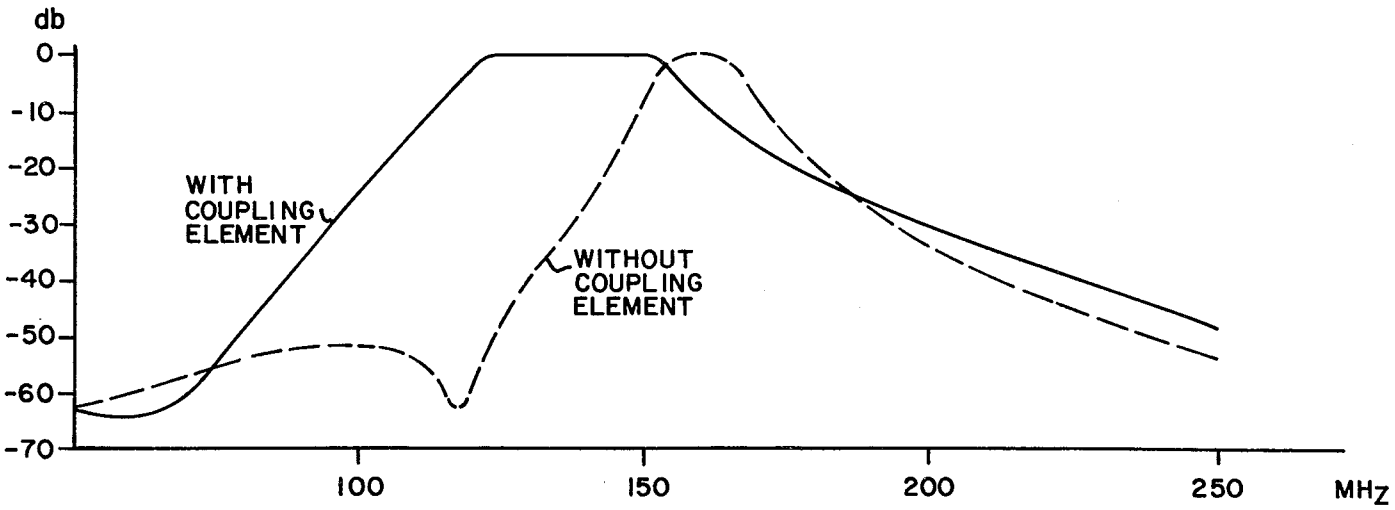
FIG. 7 shows bandwidth response characteristics of a filter illustrated in FIG. 6 and one without the coupling element.

The filter with the foregoing specific dimensions provided a response characteristics shown in solid line in FIG. 7. This compared with the response characteristics without the U-shaped at coupling elements as shown in a dotted line curve as shown in FIG. 7. It is evident by comparing the two curves that the use of the coupling elements increased the bandwidth very significantly.

In summary, helical resonator filters embodying the principles of the present invention have been described, wherein by providing a coupling element between helical coils the bandwidth of the filter can be substantially increased. It has also been shown that by using a block of insulating material with suitable grooves to receive a U-shaped coupling element and ribs of the cover so that the coupling element is centered and clamped securely to the base of the filter, thereby assuring the repeatability of filter characteristics in a production line without the need for elaborate positioning fixtures.

Modifications and changes may be made to the helical resonator filter of the present invention without departing from the principles of the present invention:

For example, both the U shaped coupling element and the conductive loop can be positioned in a filter to modify the frequency response characteristics thereof to meet particular needs.

What is claimed is:

1. A helical resonator filter comprising:

a first helical coil having first and second ends and being made of a conductive wire, said first end being electrically grounded;

a second helical coil having first and second ends and being made of a conductive wire, said first end being electrically grounded;

an electrical shielding chamber in which said first and said second helical coils are disposed adjacent each other, whereby said helical coils are electromagnetically coupled to each other so that said chamber and coils enable the filter to have a given bandwidth; and a coupling element comprised of an electrically conductive material and being placed substantially between the second end of said first helical coil and the second end of said second helical coil for modifying the bandwidth of the filter, said coupling element further being electrically isolated from said first and second coils and the electrical shielding chamber.

2. The filter according to claim 1, wherein said filter includes three or more helical coils and a conductive coupling element positioned between adjacent helical coils.

3. The filter according to claim 1 or 2, wherein the coupling element is a U-shaped copper wire of a suitable cross-section such as a round, flat or rectangular cross-section.

4. The filter according to claim 3, wherein said U-shaped element is molded inside of suitable plastic member shaped for insertion and positioning between the coils.

5. The filter according to claim 1 or 2, including a block of polypropylene or other suitable dielectric material with grooves to receive the coupling element and shaped to fit in between the two adjacent coils for providing spatial integrity of the position of the coupling element relative to the coils.

6. The filter according to claim 6, wherein said electrical shielding chamber includes a conductive metal cover and a conductive base and said block is provided with additional grooves down the side thereof into which ribs provided on the inside of the metal cover insert to center and clamp the block and coils securely to the conductive base.

* * * * *